US006277006B1

(12) United States Patent
Ghosh et al.

(10) Patent No.: US 6,277,006 B1
(45) **Date of Patent: *Aug. 21, 2001**

(54) COATED MEDIA BEARING SURFACE FOR CONVEYING ABRASIVE MEDIA AND THE LIKE

(75) Inventors: Syamal K. Ghosh, Rochester; Edward P. Furlani, Lancaster; Dilip K. Chatterjee, Rochester, all of NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/082,876

(22) Filed: May 21, 1998

(51) Int. Cl.[7] ..... B24B 7/00; B24B 9/00

(52) U.S. Cl. ..... 451/178; 451/184; 451/190; 451/194; 451/907

(58) Field of Search ..... 451/178, 184, 451/190, 194, 195, 332, 907

(56) References Cited

U.S. PATENT DOCUMENTS 4,279,500 * 7/1981 Kondo et al. ..... 355/15
4,309,495 * 1/1982 Ernsberger ..... 430/5
4,832,886 * 5/1989 Douglas ..... 264/41
4,960,643 * 10/1990 Lemelson ..... 428/408
5,097,292 * 3/1992 Hicks ..... 355/75
5,244,728 * 9/1993 Bowman et al. ..... 428/330
5,283,121 * 2/1994 Bordner ..... 428/381
5,454,844 * 10/1995 Hibbard et al. ..... 51/295
5,640,662 * 6/1997 Sugimoto et al. ..... 399/333
5,697,029 * 12/1997 Saitoh et al. ..... 399/286
5,753,373 * 5/1998 Scholz et al. ..... 428/429
5,973,715 * 10/1999 Ghosh et al. ..... 347/218
6,034,457 * 3/2000 Furlani et al. ..... 310/103

OTHER PUBLICATIONS

U.S. application No. 09/047,842, Syamal K. Ghosh et al., filed Mar. 25, 1998.

* cited by examiner

*Primary Examiner*—Allan Ostrager
*Assistant Examiner*—William Hong
(74) *Attorney, Agent, or Firm*—Clyde E. Bailey, Sr.

(57) ABSTRACT

An apparatus (10) and method for conveying abrasive web (16), such as photographic media, has a pair of closely spaced rollers (12, 14) through which the abrasive web (16) is conveyed while in contact with a coated media bearing surface (80, 90). The media bearing surface (80, 90) comprising a composite coating or a thin inorganic coating.

4 Claims, 4 Drawing Sheets

COATED MEDIA BEARING SURFACE FOR CONVEYING ABRASIVE MEDIA AND THE LIKE

FIELD OF THE INVENTION

This invention relates to an apparatus and method for conveying abrasive media. More particularly, the invention concerns such apparatus and method that utilize inorganic particulate coated conveyance rollers having durable and abrasion resistant surfaces for conveying abrasive web, such as photographic media, of indeterminate length during processing.

BACKGROUND OF THE INVENTION

Conventional web converting equipment uses some sort of transport mechanism for moving the web at high rates of speeds through a series of processing stations. Typically such processing stations include corrosive environments through which the web must be transported. For instance, in existing photographic film processors used to develop and fix photosensitive elements which are subjected to x-ray, visible, and other radiation, the web is transported via a series of rollers defining a web transport path through a sequence of processing stations including wash and dry stations.

Very often during processing, photosensitive media are coated with a magnetic layer to enable it to gather digital information. The magnetic layer often contains a small fraction of hard inorganic particles to facilitate cleaning of the magnetic head which are used for reading digital information in a read-out device. Photographic films are also coated with an "anti-staff" layer for dissipating static charges from the moving web. The anti-stat layers generally contain hard abrasive particles like tin oxide, antimony oxide, vanadium oxide, and the like.

Moreover, process and transport apparatus for photosensitive web or other media is another well known application requiring a web transport mechanism. Such equipment may include automatic processing of the media for thermal, ink jet, or silver halide-based photographic printing, and the like. The apparatus automatically transports sheets or webs or strips of photosensitive films, photosensitive papers, or specially coated papers or plain papers. For photosensitive elements, this apparatus transports from a feed end of a film transport path, through a sequence of chemical processing tanks in which the media is developed, fixed, and washed, and then through a dryer to a discharge or receiving end. The processing equipment typically has a fixed film (media) path length, so final image quality depends on factors including transport speed which determines length of time the media is in solution, and the temperature and composition of the processing chemicals.

Therefore, a need persists for an apparatus and method that makes use of an inorganic coated media bearing surface for conveying abrasive media, such apparatus having superior wear, abrasion, and corrosion resistance while being cost-effective and easy to manufacture. SUMMARY OF THE INVENTION It is, therefore, an object of the invention to provide an apparatus for conveying abrasive web, such as photographic media, of indeterminate length that utilizes compliant or semi-compliant media conveyance rollers.

Another object of the invention is to provide an apparatus for media conveyance rollers having a media bearing surface coated with semi-compliant materials having embedded therein hard wear and abrasion resistant inorganic particulate materials in a polymeric material matrix.

Yet another object of the invention is to provide an apparatus for conveying abrasive media that includes compliant media conveyance rollers having a media bearing surface coated with a thin, semi-compliant and hard inorganic coating.

Still another object of the invention is to provide an apparatus for conveying abrasive media that includes compliant media conveyance rollers having a media bearing surface comprising a hard, wear and abrasion resistant and electrically conductive particulate inorganic materials coating intended for dissipating static charges.

It is, therefore, a feature of the invention that a media bearing surface of the media for conveying abrasive media comprises an inorganic particulate coating in a polymeric matrix or a thin inorganic coating. The inorganic particulate coating may be certain metal oxides or it may be a sol-gel dispersion of select ceramics.

Accordingly, for accomplishing these and other objects, features and advantages of the invention, there is provided, in one aspect of the invention, an apparatus for conveying abrasive media of indeterminate length having a frame and closely spaced first and second rollers mounted for synchronous rotation in the frame. According to the invention, at least one of the first and second rollers has a media bearing surface comprising an inorganic particulate coating in a polymeric matrix, or a thin inorganic coating. Any sort of drive means, typically a motor, operably connected to any one of the first and second rollers rotates the roller and causes the other of first and second rollers to synchronously rotate therewith. Thus, when abrasive media of indeterminate length is disposed between the nip or close spacing between the rollers, the abrasive media is squeezed for movement between the rollers while in moving contact with the coated media bearing surface of at least one of the rollers.

In another aspect of the invention, a method of conveying abrasive media of indeterminate length includes providing the apparatus previously described and then disposing abrasive media in the nip defined by the close spacing between the first and second rollers. Any one of the first and second rollers may have a media bearing surface comprising an inorganic coating. Thus, the abrasive media, when disposed in the nip, is squeezed between the rollers on a coated media bearing surface of at least one of the rollers as the abrasive web is being conveyed between independent processing stations.

It is, therefore, an advantage of the invention that an apparatus for conveying abrasive media, such as photographic media, is simple to produce, assemble and operate. Another advantage of the invention is that the media bearing surface is sufficiently compliant to accommodate media of varying thickness. Further, the conveyance apparatus of the invention offers the advantage of providing sufficient friction to enable the movement of abrasive media between independent processing stations.

BRIEF DESCRIPTION OF THE DRAWINGS

The above mentioned and other objects, features and advantages of the invention and the manner of attaining them will become more apparent and the invention itself will be better understood by reference to the following description of an embodiment of the invention taken in conjunction with the accompanying drawings, wherein.

DETAILED DESCRIPTION OF THE INVENTION

Figure 1:
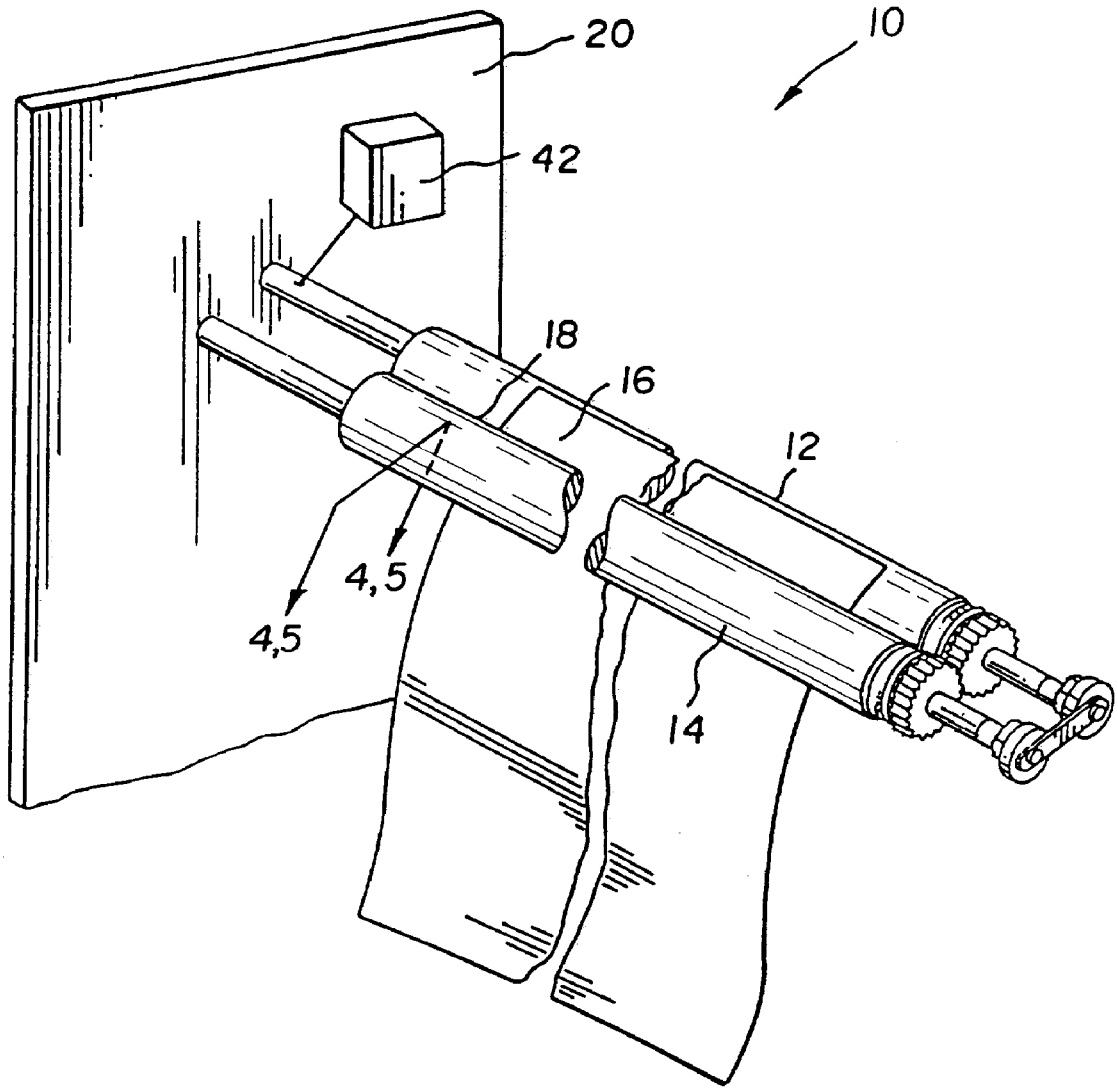
FIG. 1 is a perspective view, partially torn away, of the apparatus of the invention.
Figure 2:
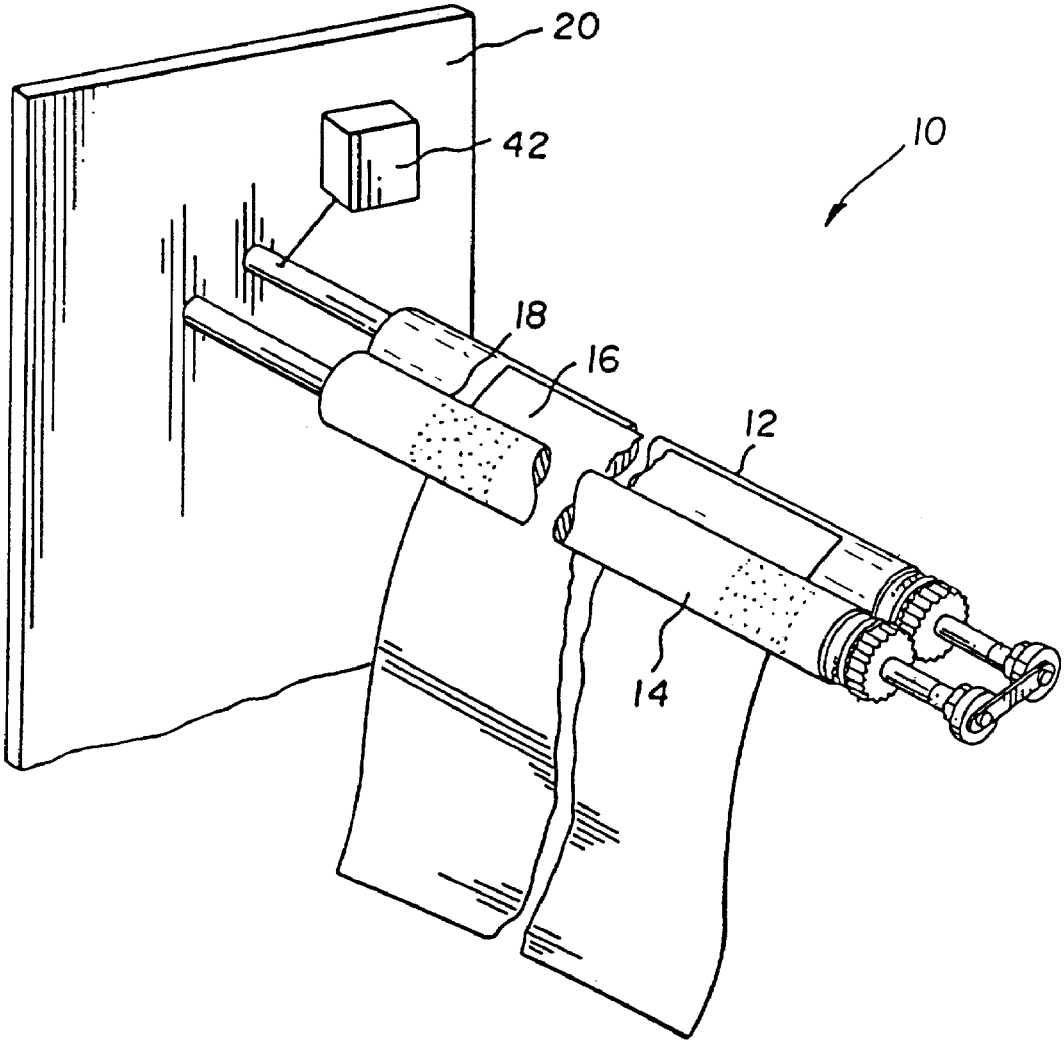
FIG. 2 is a perspective view, partially torn away, of the apparatus of the invention having one roller with a partial media bearing surface.
Figure 3:
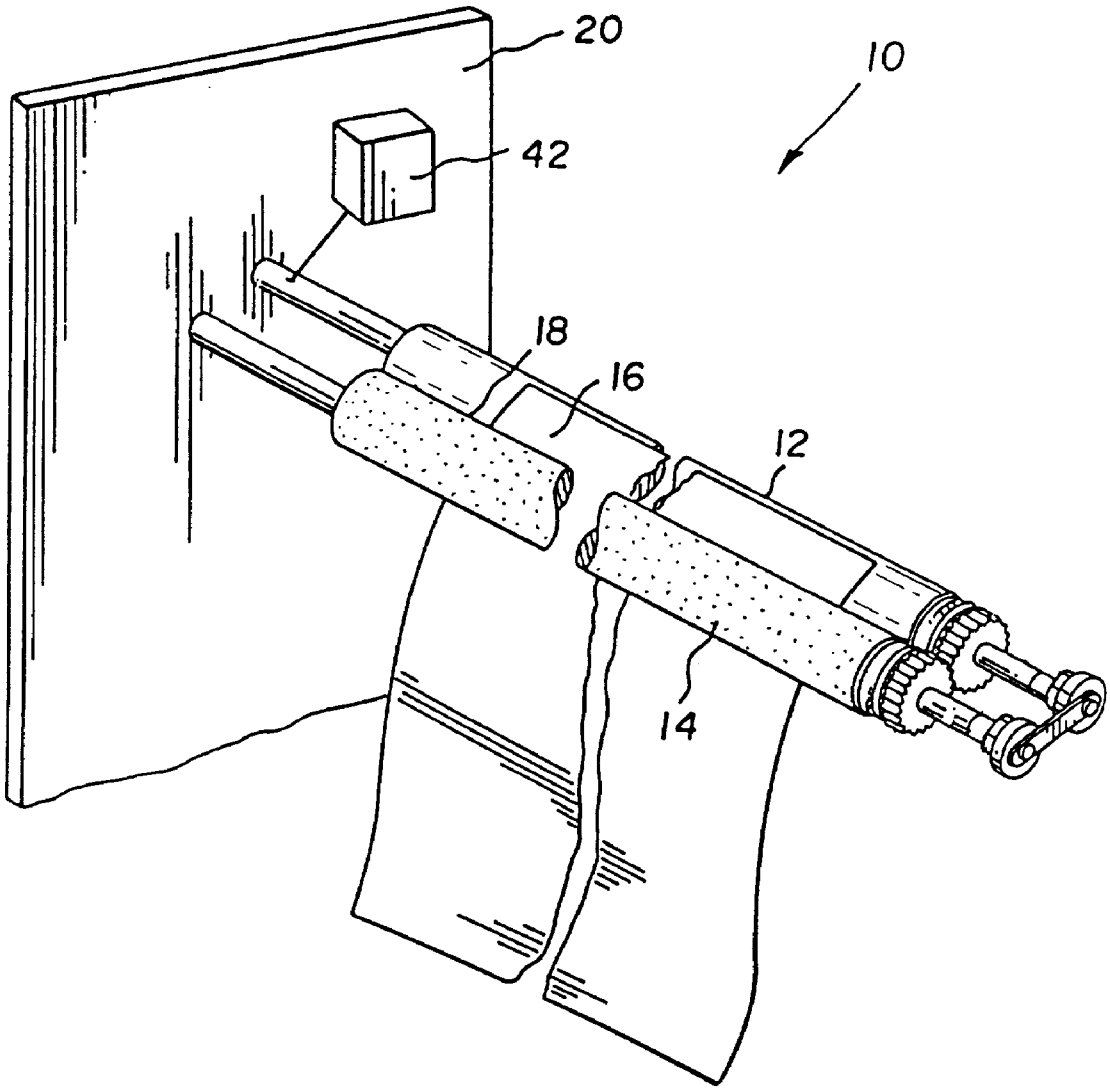
FIG. 3 is a perspective view, partially torn away, of the apparatus of having one roller with a media bearing surface.

Turning now to the drawings, and more particularly to FIGS. 1–3, web transport apparatus 10 for conveying abrasive web 16, such as photographic media, broadly defined, includes closely spaced first and second rollers 12, 14 supported in a metal frame 20. It is important to the invention, that any one of the first and second rollers 12,14 has a media bearing surface coated with an inorganic particulate in a polymeric matrix. For clarity, the media bearing surface (designated 80 in FIG. 4 or, 90 in FIG. 5) is defined as the outermost surface of the roller on which the media or web 16 rides as the web 16 is being conveyed through the transport nip or close spacing 18 between the rollers 12, 14. Skilled artisans will appreciate that while both rollers 12, 14 have media bearing surfaces 80, 90, the media bearing surface 80 or 90 need not include the entire surface area of the roller, but only the active portion of the outermost surface minimally required to promote continuous movement of the abrasive media 16 through the nip 18. It is within the contemplation of the invention that a plurality of cooperating conveyance rollers (not shown) may have coated media bearing surfaces of the type described herein. Alternatively, the media bearing surfaces 80, 90 may include a thin inorganic coating, as described below. Thus, a media bearing surface 80 or 90 having a polymeric/inorganic particulate composite coating (or alternatively, a thin inorganic coating) was selected because it provides sufficient compliancy to accommodate abrasive media of varying thickness. Importantly, as indicated, media bearing surfaces 80, 90 also provide sufficient friction to enable continuous movement of the abrasive media 16 as it is conveyed between the nip 18 of first and second rollers 12, 14. Skilled artisans will appreciate that while any one of rollers 12,14 (shown in FIG. 3) may have a media bearing surface 80, 90 comprising polymeric/inorganic particulate coating or a thin inorganic coating, it is within the contemplation of the invention that both rollers 12, 14 (shown in FIG. 1), or a portion of any of the media bearing coated surfaces 80, 90 (shown in FIGS. 4 and 5) may comprise any one or both of our preferred wear and abrasion resistant coatings.

Referring again to FIGS. 1–3, apparatus 10 includes some sort of drive means, such as a drive motor 42, operably connected to any one of the first and second rollers 12, 14 for driving at least one of the first and second rollers 12, 14. Synchronous rotation of the other of the first and second rollers 12, 14 is produced by the driven roller. As any skilled artisan will appreciate, this rotation of the first and second rollers 12, 14 causes the web 16 to be squeezed between the rollers 12, 14 while in contact with abrasive media bearing surfaces 80, 90 (FIGS. 4 and 5) for movement through the transport nip 18.

Preferably, the drive mechanism of apparatus 10 includes those elements, such as gears, ceramic bushings and ceramic sleeves that are described in details in U.S. Ser. No. 09/047,842, filed Mar. 25, 1998, entitled APPARATUS FOR PROCESSING PHOTOGRAPHIC MEDIA, by Syamal K. Ghosh, Dilip K. Chatterjee, and Edward P. Furlani, hereby incorporated herein by reference. The aforementioned arrangement of elements is preferred because of their ability to effectively operate in a corrosive environment.

Abrasive web or media 16 transportable by apparatus 10 of the invention may include a wide range of materials, including but not limited to, photographic or x-ray films, photographic papers, specialty coated papers, or plain papers. Typically, abrasive web or media 16 is introduced through the transport nip 18 formed by the spacing between the first and second rollers 12, 14. The web or media 16 is then squeezed for movement through nip 18 while being transported from one processing station to another (not shown).

Figure 4:
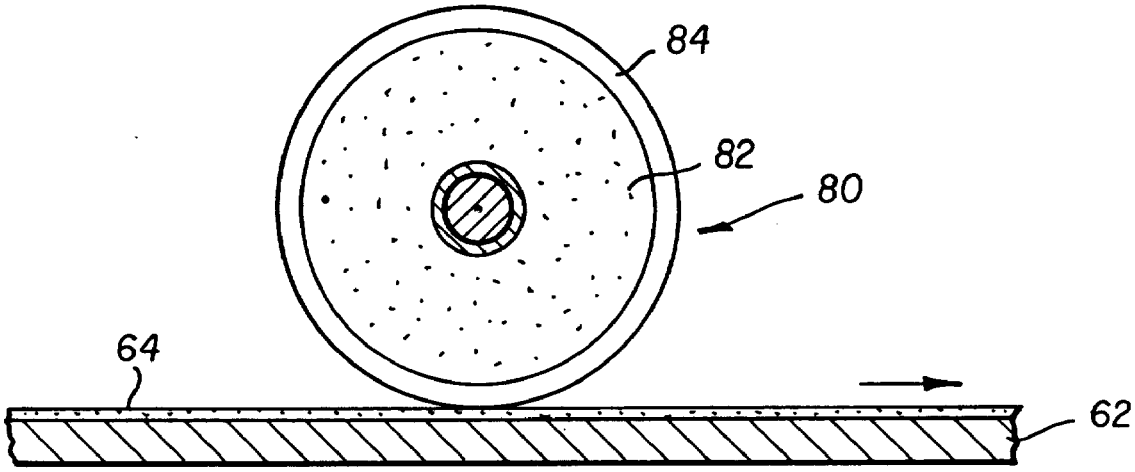
FIG. 4 is a cross-sectional view along line 4—4 of FIG. 1 depicting the coated media bearing surface of the invention in contact with abrasive media.
Figure 5:
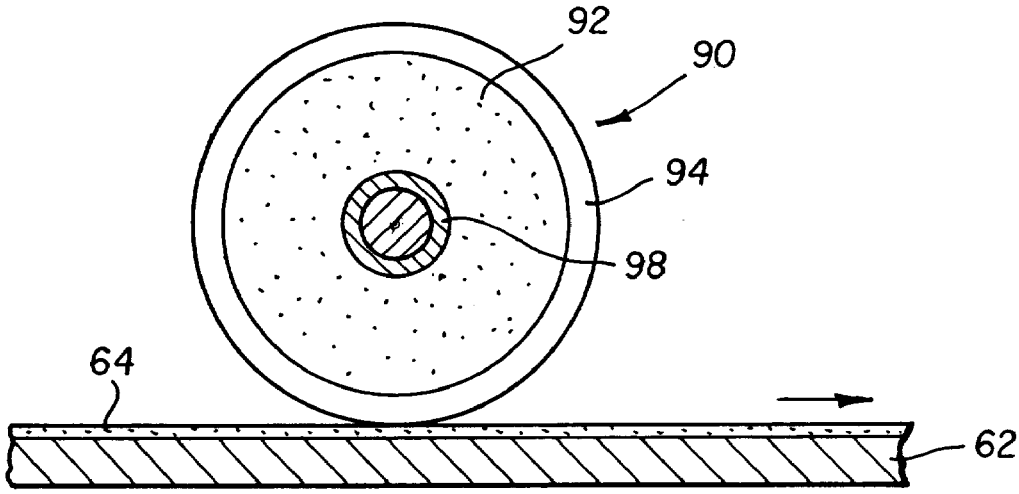
FIG. 5 is a cross-sectional view along line 5—5 of FIG. 1 depicting an alternative embodiment of the coated media bearing surface in contact with abrasive media.

Turning now to FIG. 4, a cross sectional view is shown of one of the rollers 12, 14 having abrasive media bearing surface 80 in contact with an abrasive layer or coating 64 of abrasive media 62 (also shown in FIG. 5). In the preferred embodiment, media bearing surface 80 comprises a composite coating. While there are a range of composite coatings within the contemplation of the invention, a composite coating containing polyurethane binder mixed with hard inorganic particulates is most preferred, as described below. Other embodiments may include polymeric binders, such as, polyvinyl alcohol, polyalkylene glycols, polyacrylates, and polymethacrylates.

Referring again to FIG. 4, the relatively harder shell or coating 84 of the media bearing surface 80, applied on a polymeric substrate 82, comprises primarily inorganic particles, selected from the group comprising metal oxides, metal carbides, metal nitrides, and metal borides. More particularly, such metal composites include silica, titania, zirconia, alumina, silicon carbide, silicon nitride, titanium nitride, titanium diboride, zirconium boride, and a mixture thereof.

With further reference to FIG. 4, polymeric substrate 82 is preferably made of polyurethane. Polymeric substrate 82 may also be made from other materials with similar results including synthetic rubber, polyurethane or a mixture thereof.

Preferably, coating 84 includes one or more polymeric binder materials to adhere or coalesce the inorganic particles in the coating solid form. These polymeric binders are not cross-linkable, but provide a physical bonding among the inorganic particles as well as adhesion to the polymeric substrate 82. Such binder materials include, but are not limited to, polyvinyl alcohol, polyalkylene glycols, polyacrylates, polymethacrylates, and polyurethane. The thickness of the coating or shell 84 is preferably between about 0.25 inch and about 0.001 inch, preferred being 0.01 inches. Further, the Rockwell hardness of coating 84 at 75° F. is preferably in the range between Shore hardness D 40 and D75.

The inorganic particle concentration of the shell or coating 84 should be in the range of 50 to 95% by weight, preferably in the range of between 70 to 85% by weight.

Referring now to FIG. 5, in an alternative embodiment of the invention, apparatus 10 may include at least one of the first and second rollers 12,14 having a media bearing surface 90 comprising a harder (compared to the coating described above) and semi-compliant thin coating 94 applied over a semi-compliant polymeric/inorganic particulate composite substrate 92. The relatively harder shell 94 is selected from the group comprising metal oxides, metal carbides, metal nitrides, and metal borides. More particularly, such metal composites include such materials as silica, titania, zirconia, alumina, silicon carbide, silicon nitride, titanium nitride, titanium diboride, zirconium boride, and a mixture thereof. The thin coating 94 may be applied by physical vapor deposition or thermal spray coating. Alternatively, the thin coating 94 may be accomplished by dip coating or spin coating of inorganic sol-gel particles. The sol-gel coating is performed by selecting one or more colloids of titania, zirconia, alumina, silica or a transition metal oxide. Such colloids are obtained from hydroxytitanates, hydroxyzirconates, hydroxyaluminates, or hydroxysilicates. Stable dispersions of such materials can be purchased from various commercial sources including DuPont Company. The colloidal dispersion comprising about 5 weight % solids are used and applied onto the substrate by either spin coating or dip coating. The coating is then allowed to dry at about 100° C. for about 1 to 2 hours. Preferably, the thickness of the coating or shell 94 is between about 0.001 inch and about 0.0001 inches. Further, it is preferred that the hardness of the shell 94 be in the range of about Rockwell C 30 to about Rockwell C60.

Referring again to FIG. 5, media bearing surface 90 comprises a polymeric/inorganic particulate composite substrate 92 which is formed by mixing inorganic particulate materials, preferably ceramic particles such as alumina, zirconia, silicon carbide, silicon nitride, and the like with an organic polymeric slurry comprising rubber, silicone, or polyurethane. The mixture is then cast on a metal, preferably aluminum or stainless steel, mandrel 98. The mixture contains preferably at least about 5 weight % inorganic particles and must not exceed about 50 weight % so that the hardness of the composite (polymer+inorganic particles) roller does not exceed Shore hardness A 70, and preferably lies within about 60 and about 70.

Thus, the invention has been described in detail with particular reference to certain preferred embodiments thereof, but it will be understood that variations and modifications can be effected within the spirit and scope of the invention.

Parts list web transport apparatus
first roller
second roller
abrasive media or web
transport nip
metal frame
drive motor
abrasive media
abrasive layer or coating
media bearing surface
polymeric substrate
coating or shell
media bearing surface
polymeric/inorganic particulate composite substrate
coating or shell
metal mandrel

What is claimed is:

1. Apparatus for conveying abrasive media of indeterminate length, comprising:

a frame;

first and second rollers mounted for synchronous rotation in said frame, said first and second rollers being closely spaced to form a nip therebetween, wherein at least one of said first and second rollers has a media bearing surface comprising a composite coating, said composite coating containing inorganic particulates in a polymeric binder, and an inner layer comprising a polymeric material bonded to said media bearing surface, wherein said inorganic particulates are selected from the group consisting of: metal oxides; metal carbides; metal nitrides; and metal borides, and wherein said composite coating has a Shore D hardness in the range of between 40 to 75; and, drive means operably connected to any one of said first and second rollers for rotating said any one of said first and second rollers and for causing the other of said first and second rollers to synchronously rotate therewith, wherein said media bearing surface provides sufficient friction to cause said abrasive media of indeterminate length when disposed in said nip to pass between said first and second rollers while being conveyed at least partially through said nip.

2. The apparatus recited in claim 1 wherein said metal oxides are selected from the group consisting of: alumina; zirconia; silica, titania; and mixture thereof.

3. The apparatus recited in claim 1 wherein said hard inorganic particulates is in said mixture at a concentration of between about 50% by weight and about 95% by weight.

4. The apparatus recited in claim 1 wherein the polymeric material is selected from the group consisting of: polyvinyl alcohol; polyalkylene glycols; polyacrylates; polymethacrylates; polyurethane; and a mixture thereof.

* * * * *